US006786422B1

(12) United States Patent
Wortman et al.

(10) Patent No.: US 6,786,422 B1
(45) Date of Patent: Sep. 7, 2004

(54) INFRARED HEATING ASSEMBLY

(75) Inventors: Joseph B. Wortman, Grosse Pointe Farms, MI (US); Donald Scott Fleet, Port Huron, MI (US)

(73) Assignee: Detroit Radiant Products Co., Warren, MI (US)

( * ) Notice: Subject to any disclaimer, the term of this patent is extended or adjusted under 35 U.S.C. 154(b) by 0 days.

(21) Appl. No.: 10/377,317

(22) Filed: Feb. 28, 2003

Related U.S. Application Data

(63) Continuation of application No. 10/283,754, filed on Oct. 30, 2002, now abandoned.
(60) Provisional application No. 60/340,906, filed on Oct. 30, 2001.

(51) Int. Cl.[7] ..... F24H 3/00
(52) U.S. Cl. ..... 237/70; 237/12.3 C; 431/12
(58) Field of Search ..... 237/2 A, 2 R, 237/70; 129/91 A; 431/62, 12, 18

(56) References Cited

U.S. PATENT DOCUMENTS

| | | | | |
|---|---|---|---|---|
| 3,963,018 A | | 6/1976 | Schultz | |
| 4,188,571 A | | 2/1980 | Brunson | |
| 4,390,125 A | | 6/1983 | Rozzi | |
| 4,561,421 A | * | 12/1985 | Hwang et al. | 126/110 R |
| 4,645,450 A | | 2/1987 | West | |
| 4,869,229 A | | 9/1989 | Johnson | |
| 5,027,789 A | | 7/1991 | Lynch | |
| 5,076,781 A | | 12/1991 | Cremers | |
| 5,112,217 A | | 5/1992 | Ripka | |
| 5,292,065 A | | 3/1994 | Fiedrich | |
| 5,325,821 A | * | 7/1994 | Gloersen | 122/1 R |
| 5,842,854 A | | 12/1998 | Willms et al. | |
| 6,138,662 A | * | 10/2000 | Jones | 126/91 A |
| RE37,636 E | | 4/2002 | Wortman et al. | |

FOREIGN PATENT DOCUMENTS

| | | |
|---|---|---|
| CA | 1292670 | 12/1991 |
| GB | 2189314 | 11/1989 |
| GB | 2263542 | 7/1993 |

OTHER PUBLICATIONS

Brochure: SV Series, Unitary Vacuum System by Re–Verber–Ray®, © 2001 Detroit Radiant Products.
Brochure: DRV Series, Gas Fired Infra–Red Vacuum Tube Heater System, Detroit Radiant Products,.
Brochure: HL–2 Series, Two Stage Gas Fired Infra–Red Tube Heater, © 2000 Detroit Radiant Products Co.

* cited by examiner

*Primary Examiner*—Derek S. Boles
(74) *Attorney, Agent, or Firm*—Howard & Howard

(57) ABSTRACT

A heating assembly for variably heating ambient air within a building. The heating assembly includes an elongated heating conduit. There may also be a plurality of heating assemblies 20 interconnected to each other to form a heating system for the building. If a heating system is employed, then the plurality of heating conduits will be interconnected to each other in such a manner as to define a common exhaust. A burner is connected to the inlet of the heating conduit. A fuel regulator is connected to the burner for providing fuel to the burner at a low fuel pressure, which defines a low heating temperature, and a high fuel pressure, which defines a high heating temperature. A vacuum device is connected to the exhaust of the heating conduit or conduits for pulling the air into the inlet and through the heating conduit to provide a negative pressure within the heating conduit during the heating of the air.

33 Claims, 8 Drawing Sheets

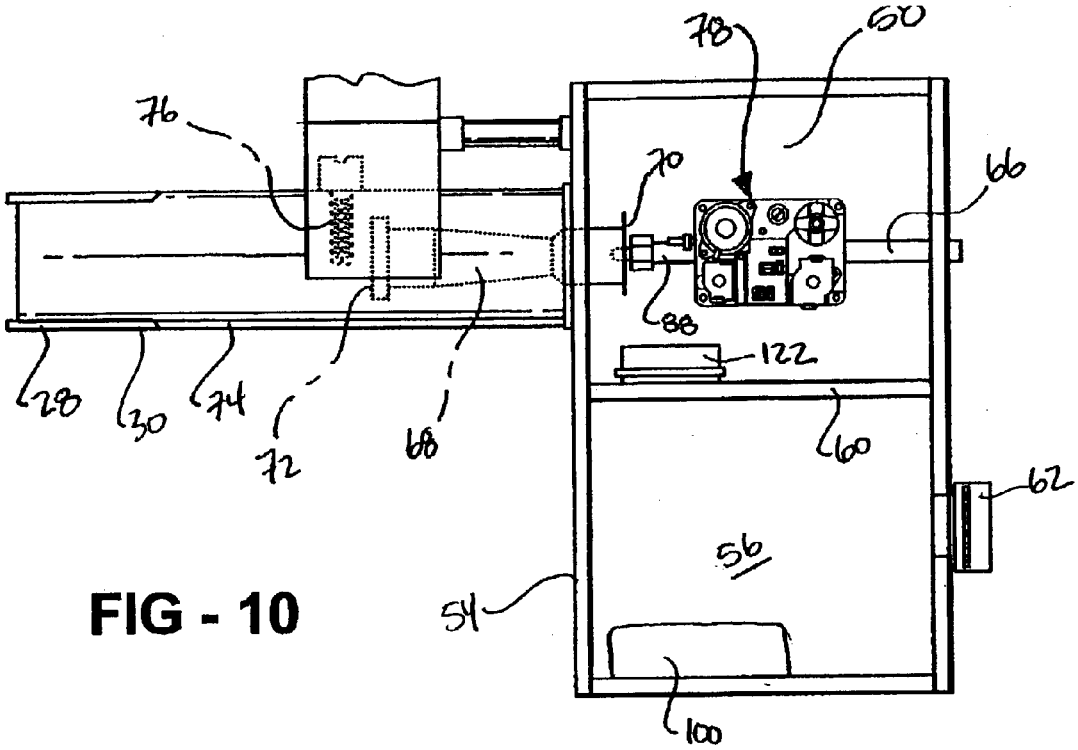
FIG - 10
FIG - 11
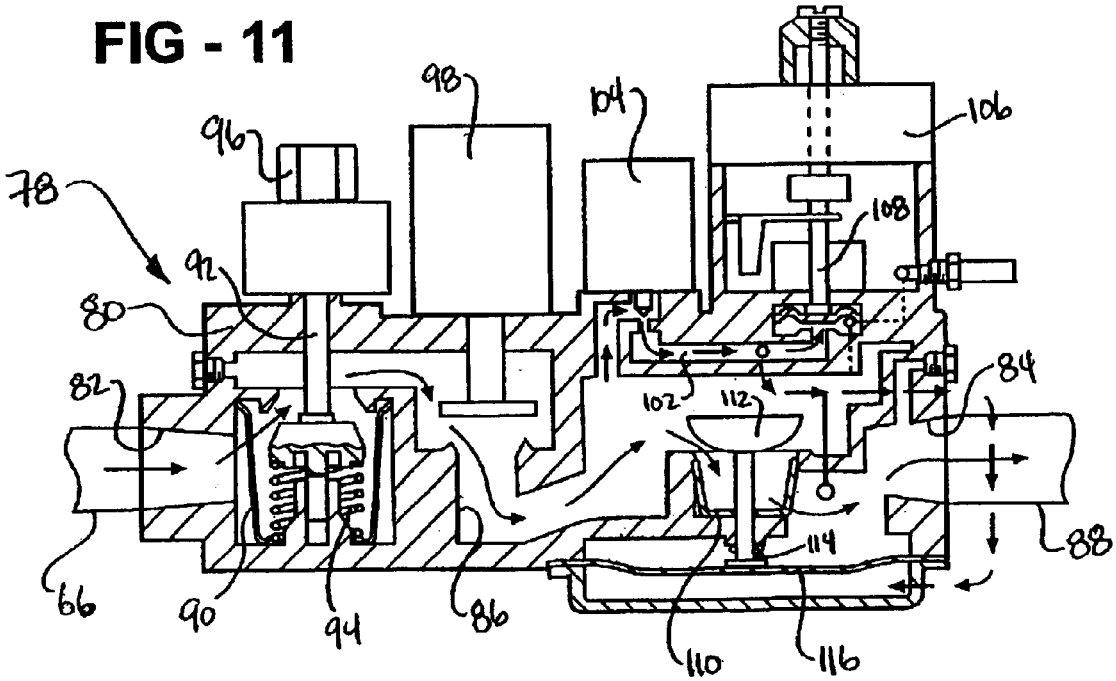

FIG - 12
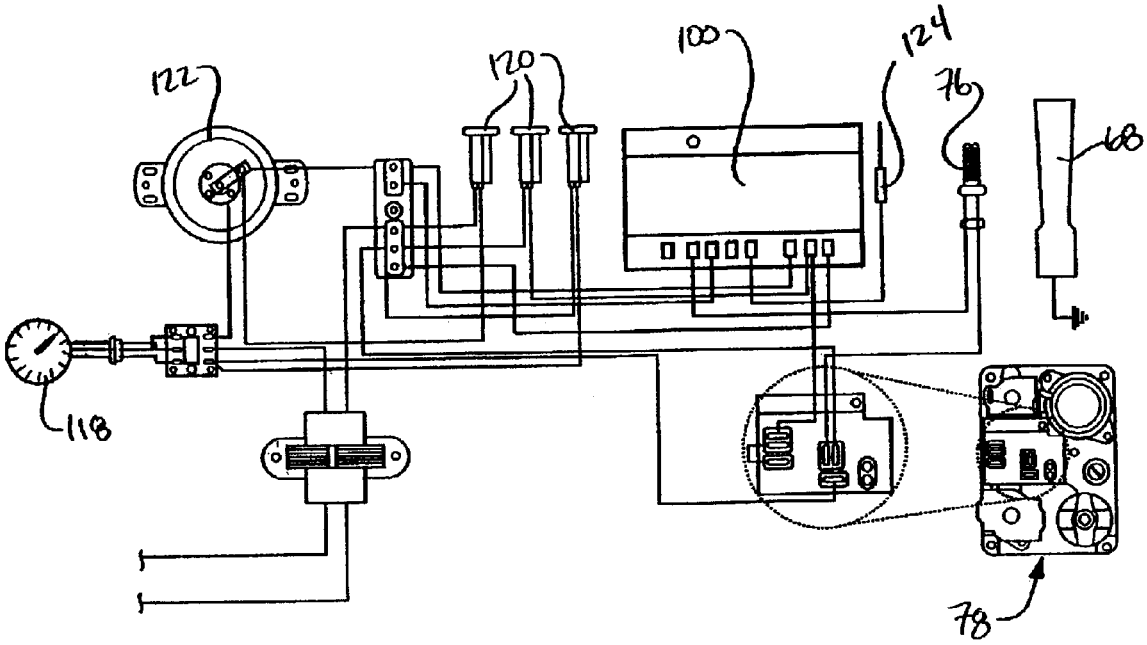
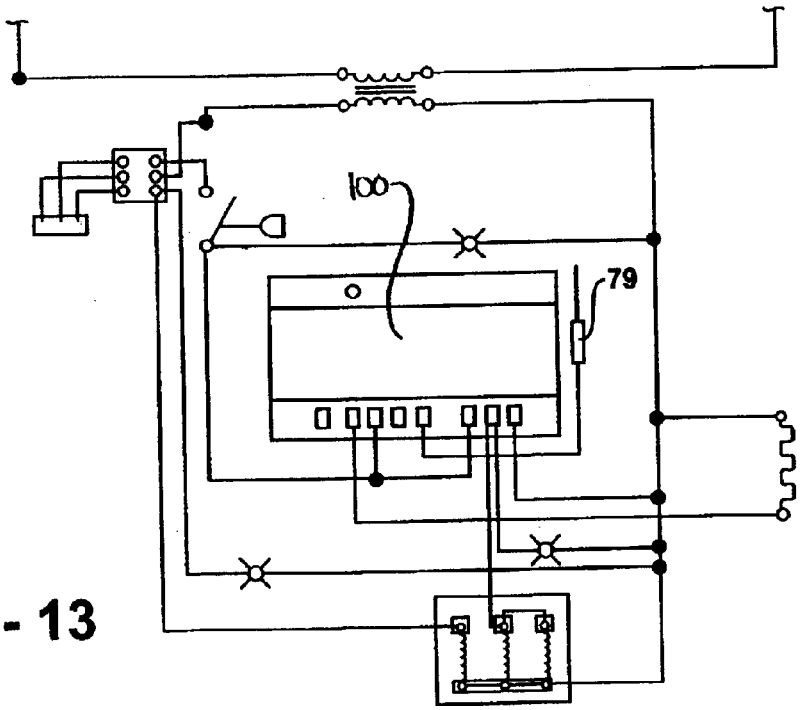
FIG - 13

INFRARED HEATING ASSEMBLY

RELATED APPLICATION

The subject application is a continuation of U.S. Ser. No. 10/283,754, filed on Oct. 30, 2002 now abandoned, which in turn claims priority to and all the benefits of U.S. Provisional Application Serial No. 60/340,906, filed on Oct. 30, 2001.

BACKGROUND OF THE INVENTION

1. Field of the Invention

The present invention relates generally to heating assemblies and, more particularly, to an infrared vacuum type heating assembly.

2. Description of the Prior Art

It is known to heat a specific location in a building or home with "forced air" systems. The forced air systems typically refer to hot air "box" heaters that force the heated air by blowing warm air over a heat exchanger and "forcing" it downward to heat an area.

It is also known to utilize radiant or infrared heating assemblies or systems to provide beat to a specific location in a building such as a warehouse, factories, aircraft hangars and the like. Radiant and infrared heating assemblies of the prior art range from hot-water pipes embedded in the floor or ceiling of a structure, to warm-air ducts embedded in the floor, to some form of electrical resistance panels applied to ceilings or walls, to other radiant and infrared heating assemblies, such as that described in U.S. Reissue Pat. No. 37,636. Panel heating is a form of radiant heating characterized by very large radiant surfaces maintained at modestly warm temperatures. With many such assemblies there is no visible heating equipment within the structure, which is an advantage in decorating. A disadvantage is the extent to which a ceiling or floor might be ruined in case of corroded or faulty hot-water piping where this method is employed.

Infrared heating assemblies have considerable benefits over conventional heating assemblies because they are more efficient and "cleaner" than other heating assemblies, thereby reducing fuel consumption and atmospheric pollution. A gas-fired infrared heating assembly emulates the efficiency of the sun. Like the sun, infrared heating assemblies generate radiant energy that is converted into heat when absorbed by objects in its path. Once the infrared energy is absorbed by floors, machinery, stock and people, it is then re-radiated to warm the surrounding air. In contrast, forced air systems simply move hot air around and waste warmth at the ceiling levels and through frequently opened doors. By directing the warning rays to the lower levels, an infrared heating assembly will provide precise control of the environment in the facility while creating pleasant working conditions for employees.

As originally conceived, such infrared heating assemblies employed a porous ceramic mat as the heating element. Fuel gas was passed through the pores of the mat and burned at the outer surface, causing the mat to heat up and emit infrared radiation. Infrared heating assemblies were further developed in which a fuel is burned in a combustion chamber and the products of combustion are conducted through an elongated conduit to cause the conduit to be heated and emit infrared radiation. The conduit is typically not heated to the point of emitting visible light.

In one example of these infrared heating assemblies, a closed loop circuit is employed in which the combustion products are re-circulated through the heating conduit to eliminate the need to heat air from ambient temperatures up to combustion temperatures, and thus improve the heat efficiency of the assembly. However, infrared heating assemblies of this type are complex and expensive to install. Further, the heat capacity of the air is small such that there is little practical value to such infrared heating assemblies.

Other infrared heating assemblies employ a single-pass concept in which the combustion gases arc not recycled, but are exhausted from the heating conduit to the atmosphere either directly or through a stack. One type of single-pass heating assembly includes a single atmospheric burner which utilizes the natural buoyancy of hot combustion gases to draw combustion air into a burner. Other types of the single-pass heating assemblies utilize some means to induce the flow of combustion gas through the heating conduit. In particular, a "push assembly" incorporates a blower mounted at an inlet of the heating conduit and positive pressure is used to force a flame down a conduit. The infrared heating assembly disclosed in U.S. Reissue Pat. No. 37,636 incorporates such a pushing blower. Alternatively, an exhaust fan can be mounted at an outlet of the heating conduit that draws the combustion gases through the conduit. This type of infrared heating assembly is known as a vacuum type heating assembly or "pull assembly". Vacuum type heating assemblies, or "pull assemblies", are gas-fired infrared heaters that use negative pressure to draw a flame down the heating conduit. Vacuum type heating assemblies are desirable in the industry because of the perceived safety factors associated with negative pressure assemblies, increased venting options and potentially improved thermal efficiencies. In addition, the use of vacuum type heating assemblies provide a simplified centralized control assembly, and the number of vent penetrations may be reduced.

The vacuum type heating assemblies can have single or multiple burners within the same heating conduit, and generally provide the longest heat exchanger lengths. Heating assemblies of this type are typically of a pre-mix configuration, mixing air and gas as completely as possible before ignition. This is particularly critical when using multiple burners, as better mixing is required to avoid difficulties of combustion contamination at downstream burner locations.

Conventional vacuum type heating assemblies include four to six burners in line for smaller firing rates or two to three burners in line for larger firing rates. The burners operate in series relative to one another along a length of the heating conduit.

In designing these assemblies, consideration is given to the overall flow volume relationships and the capacity of a vacuum fan or pump that provides negative pressure on the entire network of heating conduits. Conduit lengths vary according to selected heating requirements and desired thermal efficiency, with longer lengths of conduits providing higher thermal efficiency and a wider heating distribution area. Each burner is equipped with fuel and air orifices in a proportion required for acceptable combustion. The vacuum fan or pump at an end of the heating assembly establishes a negative pressure at each burner that determines the fuel and airflow rate through each burner. The vacuum fan further draws combusted gases to an outlet for proper emission of combusted gases.

The laws of physics for fluid flow dictate that for a given vacuum setting, each burner in a multiple burner experiences a different vacuum level. More particularly, the negative pressure differential or vacuum experienced by a burner closer to the vacuum fan is greater than the burner further from the vacuum fan. Therefore, and contrary to forced air assemblies, burners in a vacuum system must be balanced to equal pressures. Accordingly, burner size is limited due to unacceptable combustion conditions caused by increasing vacuum or negative pressure differential along the length of the heating conduit toward the vacuum fan.

Furthermore, conventional vacuum type heating assemblies have not provided multiple temperature settings, also known as demand heating. In other words, the conventional vacuum type heating assemblies do not have the capability of two-stage heating or temperature settings such that the fuel regulator and burner or burners are operating at different fuel pressures. Two-stage heating is particularly advantageous in that it reduces the number of on/off cycles for the heating assembly. Further, the heating assembly is operating the majority of the time in a low heating mode which provides significant fuel savings and improved comfort levels.

Accordingly, it would be desirable to develop a heating assembly which utilizes the advantages attendant to a vacuum heating system and a two-stage heating assembly while avoiding the deficiencies.

SUMMARY OF THE INVENTION AND ADVANTAGES

A heating assembly for variably heating ambient air. The heating assembly comprises an elongated heating conduit having an inlet and an exhaust. A burner is operatively connected to the inlet of the heating conduit for heating the ambient air to a plurality of predetermined temperatures as the air passes through the inlet. A fuel regulator is operatively connected to the burner for providing fuel to the burner at a low fuel pressure, which defines a low heating temperature, and a high fuel pressure, which defines a high heating temperature, such that the air can be heated to the plurality of predetermined temperatures. A vacuum device is connected to the exhaust of the heating conduit for pulling the air into the inlet and through the heating conduit to provide a negative pressure within the heating conduit during the heating of the air.

The subject invention may also include a plurality of heating assemblies interconnected to each other to form a heating system for the building. The heating systems would likewise includes a plurality of burners and fuel regulators. If a heating system is employed, then the plurality of heating conduits will be interconnected to each other in such a manner as to define a common exhaust. A single vacuum device is mounted to the common exhaust for pulling air into the inlets of each of the heating conduits in the heating system.

Accordingly, the subject invention provides a vacuum type heating assembly that provides dual heating settings. Thus, the subject invention mates the advantages of a two-stage heating operation having low and high heat settings with a vacuum heating assembly and its attendant advantages. Additionally, a simplified centralized control assembly can be used to provide all of these advantages in a vacuum heating assembly, which reduces the number of vent penetrations.

BRIEF DESCRIPTION OF THE DRAWINGS

Other advantages of the present invention will be readily appreciated as the same becomes better understood by reference to the following detailed description when considered in connection with the accompanying drawings wherein:

FIG. 10 is a top view of a housing of the heating assembly;

FIG. 11 is a cross-sectional view of a fuel regulator;

FIG. 12 is a wiring diagram of the heating assembly; and

FIG. 13 is a wiring diagram of an ignition control module.

DETAILED DESCRIPTION OF THE PREFERRED EMBODIMENT

Figure 1:
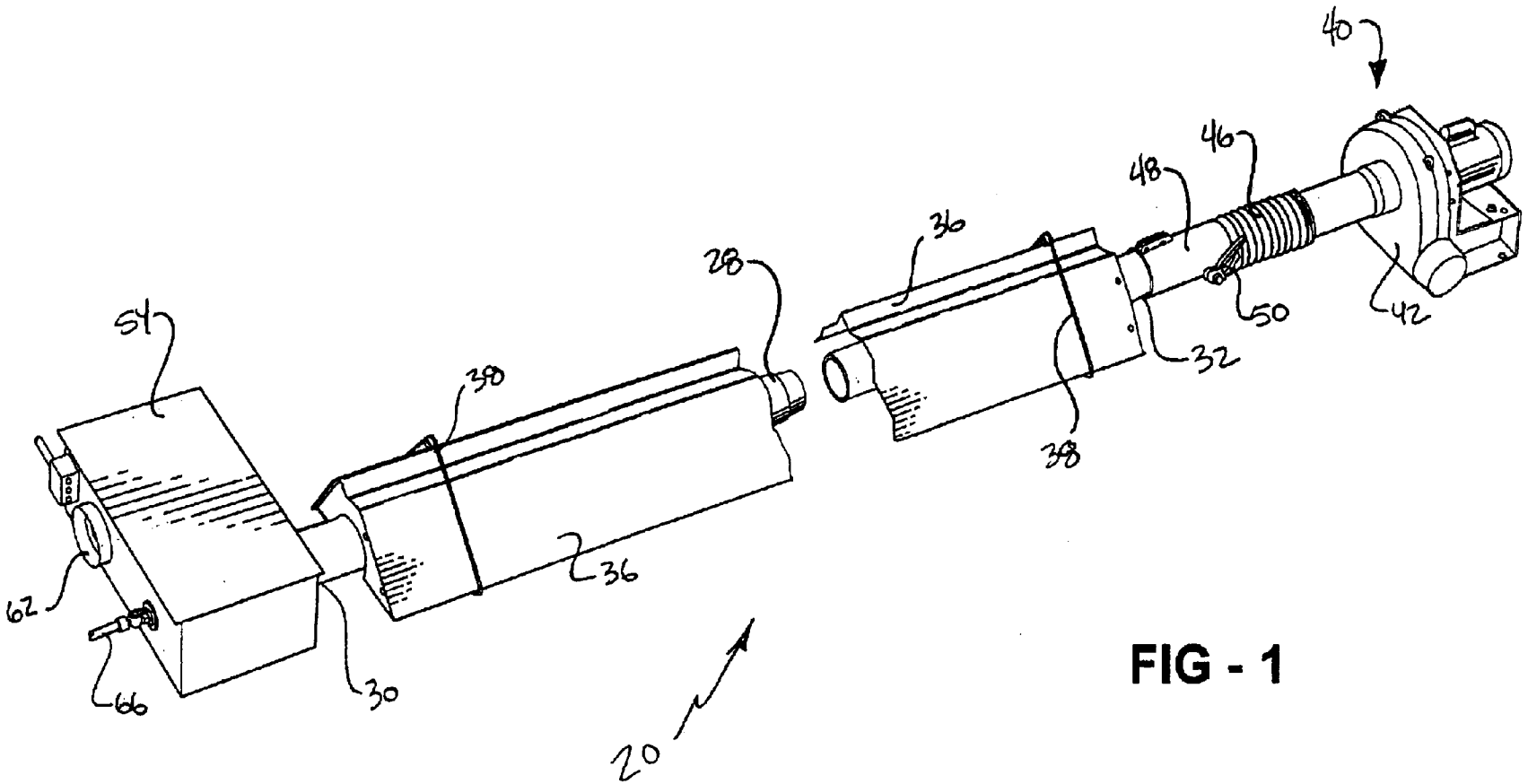
FIG. 1 is a perspective view of a heating assembly in accordance with the subject invention.
Figure 2:
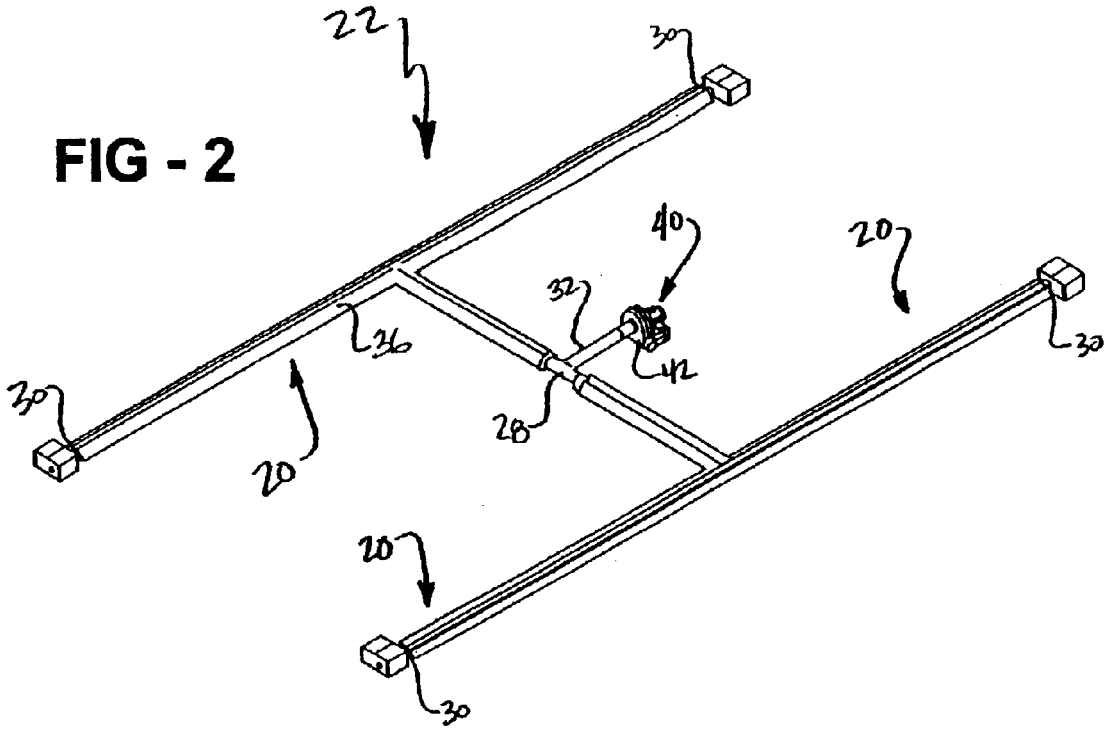
FIG. 2 is a plurality of interconnected heating assemblies forming a heating system in accordance with the subject invention.
Figure 3:
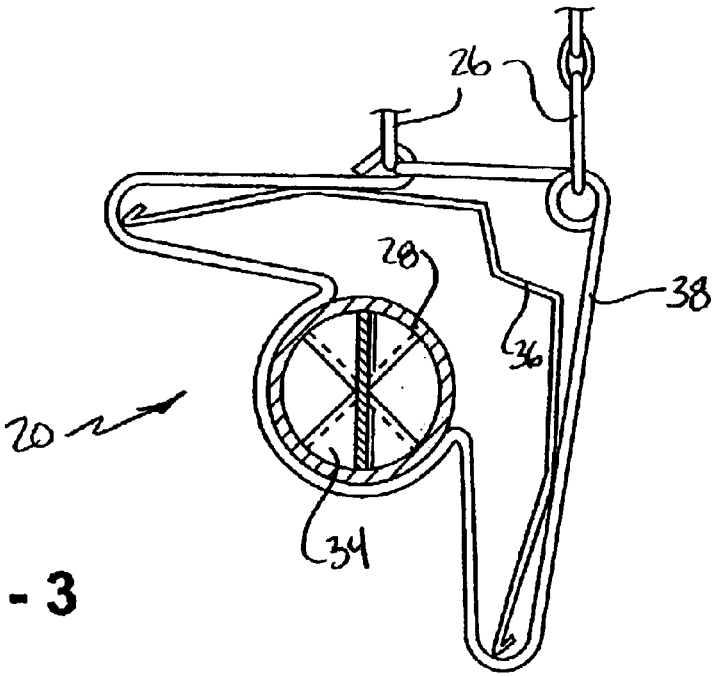
FIG. 3 is a cross-sectional view of the heating assembly of FIG. 1.
Figure 4:
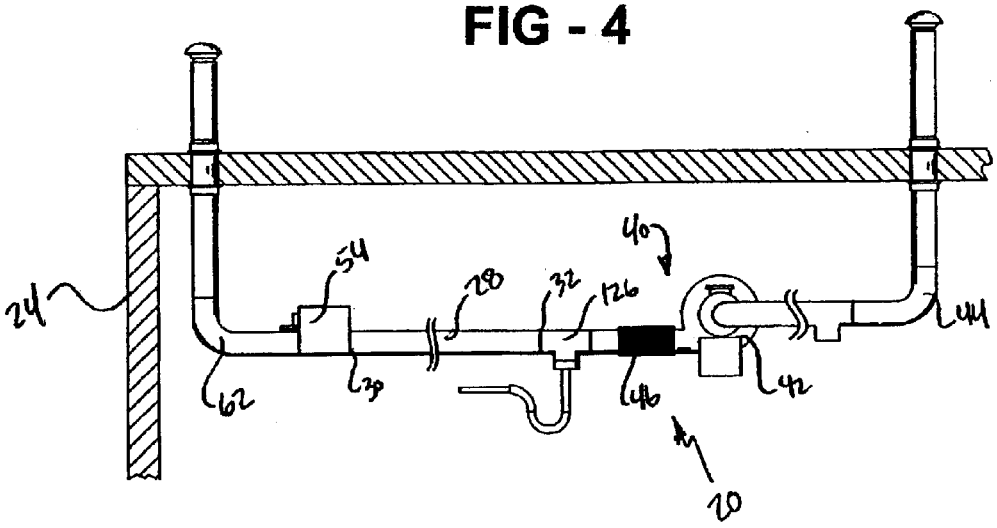
FIG. 4 is a schematic side view of the heating assembly illustrating a typical installation.
Figure 5:
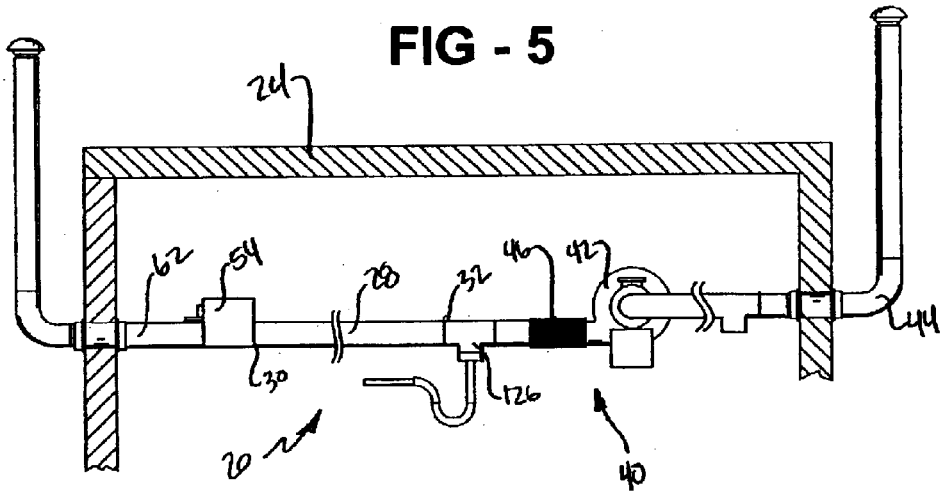
FIG. 5 is a schematic side view of the heating assembly illustrating another typical installation.
Figure 6:
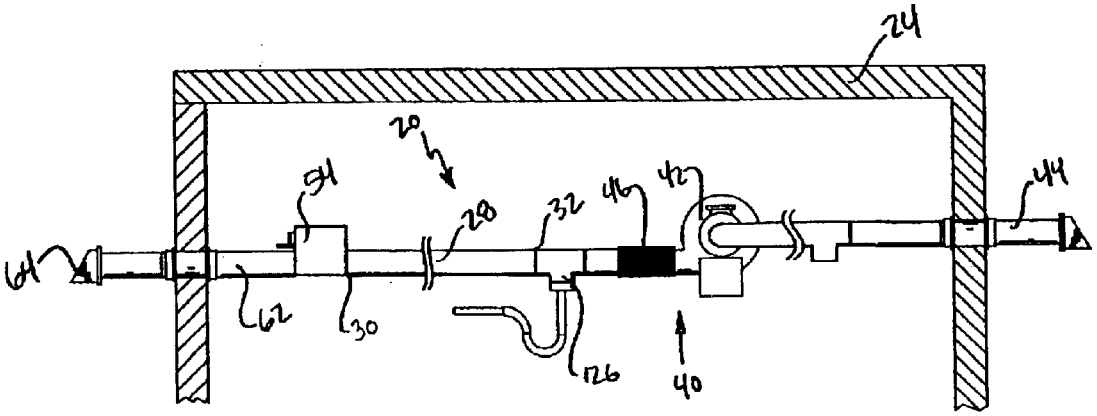
FIG. 6 is a schematic side view of the heating assembly illustrating yet another typical installation.

Referring to the Figures, wherein like numerals indicate like or corresponding parts throughout the several views, a heating assembly for variably heating ambient air is generally shown at 20 in FIG. 1. As shown in FIG. 2, there may be a plurality of heating assemblies 20 interconnected to each other to form a heating system 22 for a building 24. The heating assemblies 20 may be interconnected in any variety of configurations depending upon the area to be heated. Referring to FIGS. 4–6, typical installations of the heating assembly 20 are shown installed in a building 24 such as a warehouse, factory or aircraft hangar for heating a specific location within the building 24. As also shown in FIG. 3, the heating assembly 20 or system 22 of the present invention is typically suspended from a ceiling of the building 24 by chains 26, hangers, and/or any other suitable means. It should be appreciated that the chains 26, space the heating assembly 20 or system 22 from the ceiling so as to avoid undue heating of the ceiling. The specifics of the heating assembly 20 and system 22 will be discussed in greater detail with reference to a single heating assembly 20 and it should be understood that each of the heating assemblies 20 within a heating system 22 are substantially similar.

Figure 7:
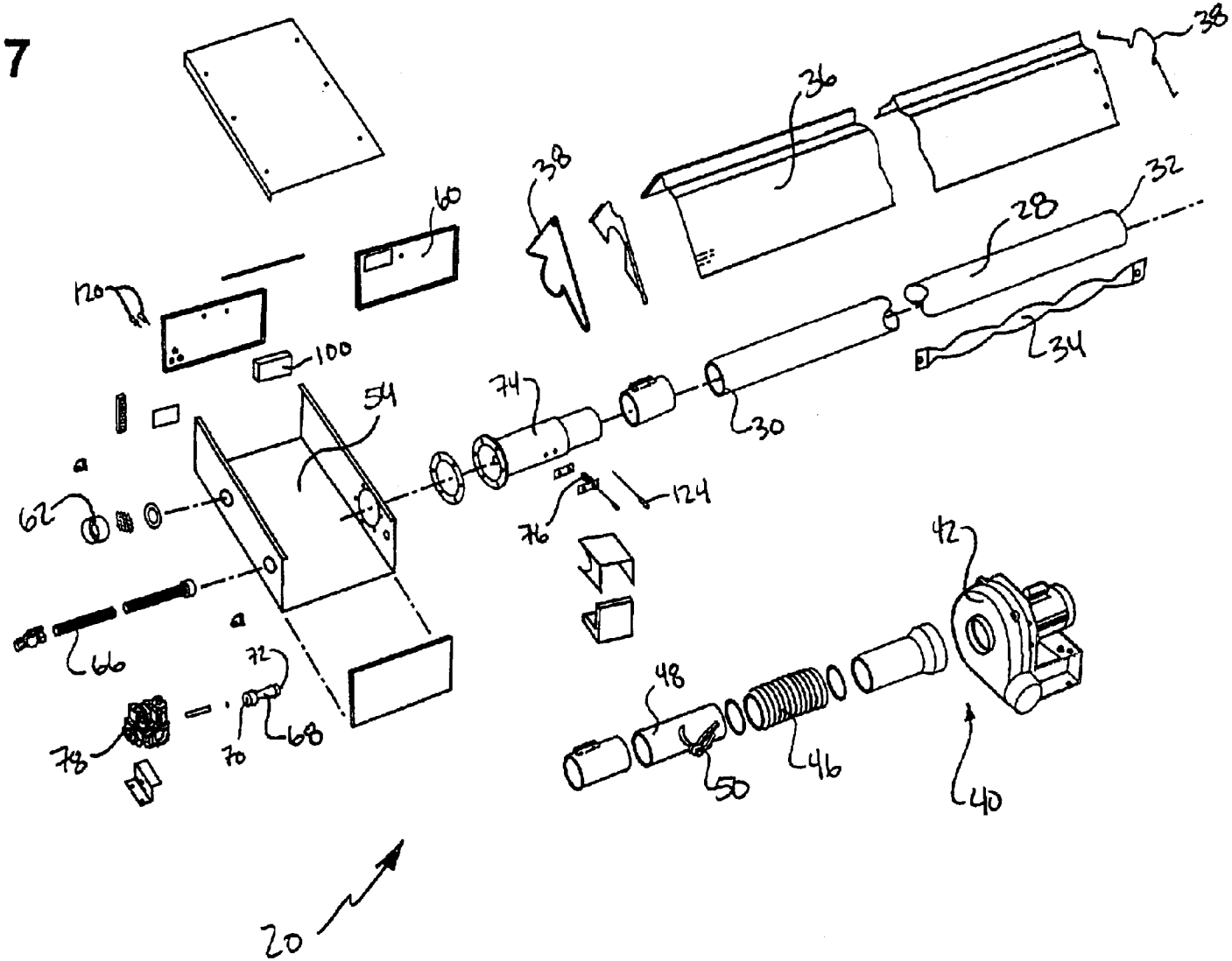
FIG. 7 is an exploded perspective view of the heating assembly.
Figure 8:
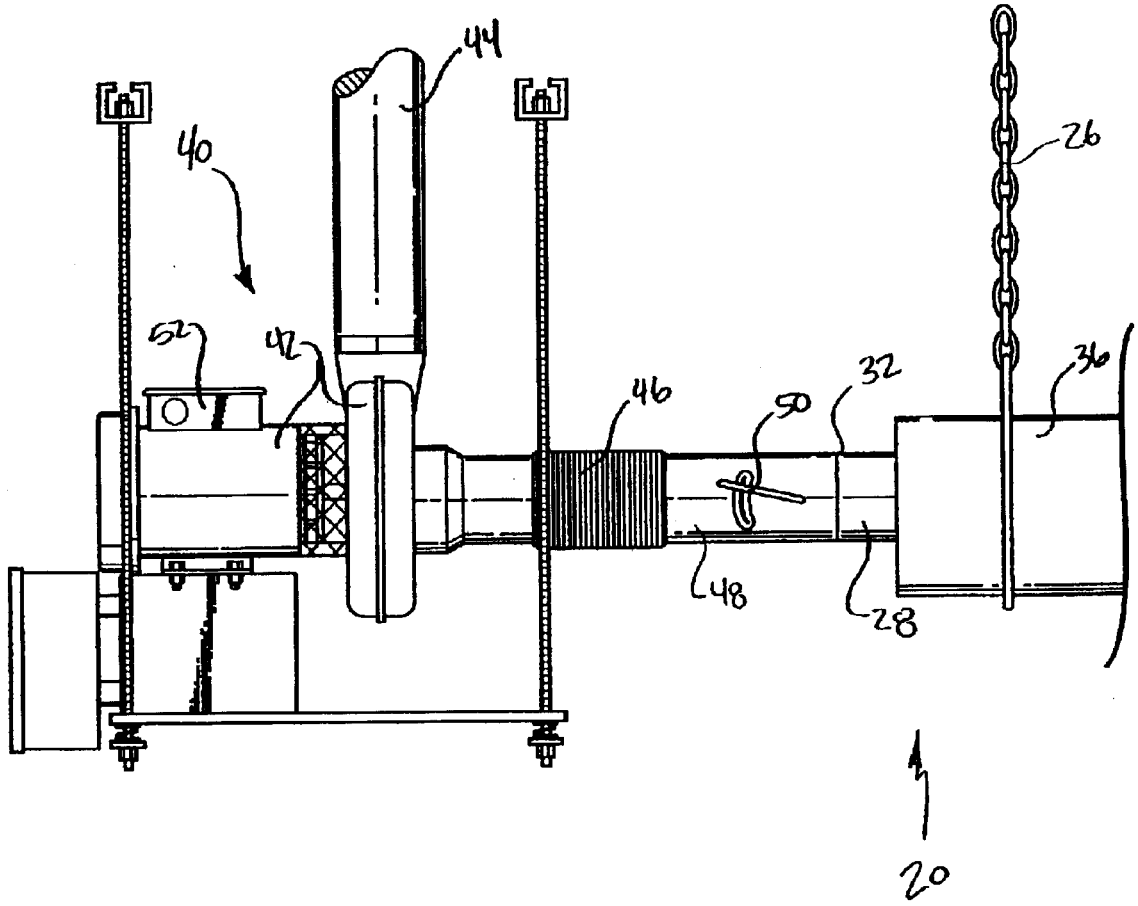
FIG. 8 is an enlarged fragmentary view of a vacuum device of the heating assembly.
Figure 9:
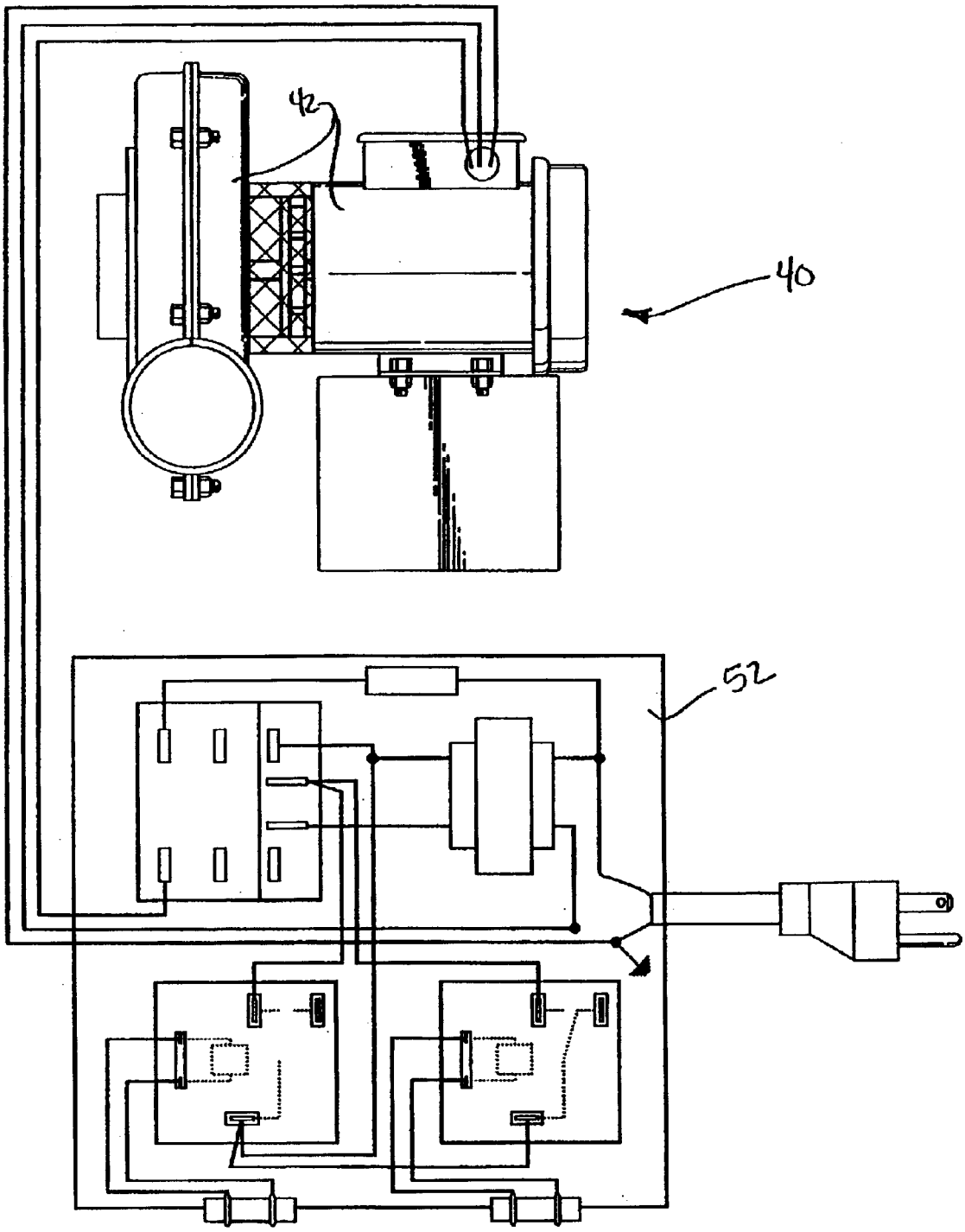
FIG. 9 is an enlarged plan view of the vacuum device.

Turning to FIGS. 1–7, the heating assembly 20 includes at least one heating conduit 28 having an inlet 30 and an exhaust 32. If a heating system 22 is employed, then the plurality of heating conduits 28 will be interconnected to each other in such a manner as to define a common exhaust 32. The heating conduit 28 preferably has a uniform tubular configuration defining a combustion chamber. As discussed in greater detail below, a mixture of air and fuel initially enter the inlet 30 of the heating conduit 28. The mixture of air and fuel are then ignited to produce a heated flow of exhaust gases which flows down the heating conduit 28 to heat the conduit. As shown in FIGS. 3 and 7, the heating conduit 28 may include an elongated sinuous deflector 34 disposed within the combustion chamber to cause the exhaust gases to flow in a helical path through the heating conduit 28. The deflector 34 serves to control the pressure and velocity of the exhaust gases within the heating conduit 28. It should be appreciated that the heating conduit 28 may be U-shaped and contain a plurality of the deflectors 34. In addition, as known to those skilled in the art, the heating conduit 28 may have any suitable configuration and be of any suitable length.

As best shown in FIGS. 1, 3, and 7, the heating assembly 20 further includes a reflector 36 mounted to the heating conduit 28 by a plurality of brackets 38 or any other suitable means. The brackets 38 which mount the reflector 36 may also be the same brackets 38 which arc connected to the chains 26 to support the entire heating assembly 20. The reflector 36 reflects the radiant energy, i.e., heat, infra-red, emitted by the heating conduit 28.

Referring to FIGS. 1 and 7–9, the heating assembly 20 further includes a vacuum device 40 connected to the common exhaust 32 of the heating conduit 28 or conduits 28 for pulling the air into the inlet 30 and through the heating conduit 28 to provide a negative pressure within the heating conduit 28 during the heating of the air The heating assembly 20 of the present invention is therefore a vacuum type heating assembly 20. The vacuum device 40 includes a vacuum fan 42 for pulling the air through the heating conduit 28 and creating the negative pressure. An exhaust stack 44 is connected to the fan 42 for directing the flow of air away from the fan 42 and for exhausting combusted gases and by-products to the atmosphere. As shown in FIGS. 4–6, the exhaust stack 44 exits through a wall or ceiling of the building 24 to allow cooled exhaust gases and/or combustion products to exit to the atmosphere outside of the building 24. A vibration isolation boot 46 is mounted between the heating conduit 28 and the fan 42 for absorbing any vibrations, expansion or contraction, caused by the fan 42. In addition, a transition pipe 48 is mounted between the heating conduit 28 and the vibration isolation boot 46. A mechanical damper 50 is disposed within the transition pipe 48. The vacuum device 40 further includes a controller 52 electrically connected to the fan 42 for controlling the operation of the fan 42.

Referring to FIGS. 1, 7, and 10, the heating assembly 20 further includes a component housing 54 which is internally divided into first 56 and second 58 compartments that are gas sealed from each other by a divider 60. Preferably, the housing defines air tight first 56 and second 58 compartments. For illustrative purposes, the electrical wiring between the various components within the housing 54 is not shown. The housing 54 is connected to the inlet 30 of the heating conduit 28 with the vacuum device 40 being disposed outside of and spaced from the housing 54. As also shown in FIGS. 4–6, an optional intake tube 62 is coupled to the first compartment 56 of the housing 54 and also exits through a wall of the building 24 to allow ambient air to enter the component housing 54. The intake tube 62 may include a shield 64 at a distal end thereof. It should be appreciated that the amount and pressure of the intake air is controlled by the size of a damper tube 42 so as to result in an optimum air/fuel mixture. In some buildings 24, the intake tube 62 may pass through the ceiling.

A fuel line 66 is mounted to the housing 54 and extends into the second compartment 58 to allow fuel from a fuel source (not shown) to enter the component housing 54. The fuel is typically natural gas, propane, or any other suitable fuel.

As best shown in FIGS. 7 and 10, a burner 68 is operatively connected to the inlet 30 of the heating conduit 28 for heating the ambient air to a plurality of predetermined temperatures as the air passes through the inlet 30. As can be appreciated, if there are a plurality of heating assemblies 20 connected together to form the heating system 22, then there will be a corresponding burners 68 for each of the heating assemblies 20. Preferably, the burner 68 is mounted to the housing 54 and is at least partially disposed within the housing 54. The burner 68 includes an inlet 70 and an outlet 72 with the inlet 70 adapted to receive air and fuel and the outlet 72 adapted to emit an air and fuel mixture for subsequent combustion. The burner 68 has a circular venturi shaped configuration extending between the inlet 70 and outlet 72. A screen (not shown) is mounted to both the inlet 70 and outlet 72 of the burner 68 with the screens defining a plurality of openings for allowing air and fuel to pass therethrough. A plurality of vanes (not shown) are mounted circumferentially around both the inlet 70 and outlet 72 of the burner 68 for swirling the air and fuel mixture passing therethrough.

A burner tube 74 is interconnected between the inlet 30 of the heating conduit 28 and the component housing 54. In particular, the burner tube 74 includes a flange secured to the housing 54 by fasteners or any other suitable means. The burner tube 74 is coupled to the heating conduit 28 by wrap around couplings or any other suitable means. The vanes of the burner 68 locate and support the burner 68 within the burner tube 74.

An igniter 76 is mounted adjacent the burner 68 in line with the outlet 72 for igniting the air and fuel mixture. Preferably, the igniter 76 is a glow bar igniter 76 which reaches a predetermined temperature, such as 2,200° F. Such glow bar igniters 76 are known to those skilled in the art and are commercially available.

Referring also to FIGS. 10 and 11, the housing 54 includes a fuel regulator 78 mounted in the second compartment 58 and connected to the fuel line 66. The fuel regulator 78 is operatively connected to the burner 68 for providing fuel to the burner 68 at a low fuel pressure, which defines a low heating temperature, and a high fuel pressure, which defines a high heating temperature, such that the air can heated to the plurality of predetermined temperatures. In the preferred embodiment, the fuel regulator 78 is a two-stage single fuel regulator 78 for providing a single fuel at the two different pressures. The low fuel pressure and high fuel pressure correlate to low and high temperature settings, which are also known in the art as low and high demand heating. In addition, the low and high fuel pressures are also known in the art as low and high fire modes. The high fuel pressure, defining the high heating temperature of the heating conduit 28, correlates to a higher rate of heating where it is desired to elevate the ambient air temperature as quickly as possible. The low fuel pressure, defining the low heating temperature of the heating conduit 28, correlates to a lower rate of heating once a desired temperature setting for the air in a particular location has been reached. Preferably, the high fuel pressure, or high fire mode, has a rated BTUH input which is greater than the low fuel pressure, or low fire mode. The two-stage fuel regulator 78 is particularly advantageous in that the high fuel pressure, or high fire mode, is typically only required for 7% to 15% of the total heating hours. Therefore, the heating assembly 20 can operate the majority of the time in the low fuel pressure or low fire mode, which significantly conserves on fuel. The prior art vacuum type heating assemblies 20 discussed above only operate at a single fuel pressure, which is the high fuel pressure or high fire mode.

The fuel regulator 78 includes a manifold 80 having an inlet 82 and an outlet 84 interconnected by an internal primary passageway 86. The fuel line 66 is mounted to the inlet 82 and a connecting line 88 is anchored to the outlet 84. The connecting line 88 includes a fuel orifice which extends into one end of the burner 68. It should be appreciated that fuel enters the burner 68 through the connecting line 88 and the fuel orifice.

The fuel regulator 78 also includes a conical inlet screen 90 disposed in the primary passageway 86 after the inlet 70 and a manual on/off valve 92 disposed adjacent thereto. The manual valve 92 is loaded by a spring 94 to open and close a first opening in the primary passageway 86. The manual valve 92 has a manual on/off fuel knob 96 for adjusting the position of the manual valve 92 relative to the first opening. The fuel regulator 78 also includes a redundant solenoid 98 for opening and closing a second opening in the primary passageway 86. The redundant solenoid 98 is electrically connected to an ignition control module 100, which is discussed in greater detail below. The redundant solenoid 98 is essentially a safety mechanism to stop the flow of fuel if the beating assembly 20 is not operating properly.

The fuel regulator 78 has a secondary passageway 102 connected to the primary passageway 86 after the second opening. Both the primary 86 and secondary 102 passageways are in fluid communication with the outlet 84. The fuel regulator 78 includes a main solenoid 104 for opening and closing a first opening in the secondary passageway 102 and a second stage solenoid 106 connected to a regulator valve 108 for increasing and decreasing a manifold pressure of the fuel. The second stage solenoid 106 includes a low regulator adjust connected to the regulator valve 108 to adjust the manifold pressure for defining the low and high fuel pressures. The fuel regulator 78 also includes a conical outlet screen 110 disposed in the primary passageway 86 before the outlet 84 and an outlet valve 112 disposed in the primary passageway 86 before the outlet screen 110. The outlet valve 112 is loaded by a spring 114 and controlled by a diaphragm 116 to open and close a third opening in the primary passageway 86. The diaphragm 116 moves the outlet valve 112 in response to low or high fuel pressure from the second passageway on one side of the diaphragm 116.

Preferably, the fuel regulator 78 provides a low fuel pressure at 1.6 inch W.C. for what is known in the art as low demand heating. Further, the fuel regulator 78 preferably provides a high fuel pressure at 3.5 inch W.C. for what is known in the art as high demand heating. The preferred low and high fuel pressures apply over an ambient temperature range of −40° F. to 175° F. As appreciated, the low and high fuel pressures can vary and the preferred pressures set forth above are in no way designed to be limiting.

As shown schematically in FIG. 12, the heating assembly 20 may be controlled by any suitable thermostat 118. The thermostat 118 is operatively connected to the fuel regulator 78 for activating the fuel regulator 78 to provide fuel to the burner 68 at the low and high fuel pressures based upon a plurality of temperature settings. The thermostat 118 is further defined as a two-stage thermostat 118 having a low temperature setting for triggering the low fuel pressure and defining the low heating temperature, and a high temperature setting for triggering the high fuel pressure and defining the high heating temperature. The thermostat 118 is preferably electrically connected to the main solenoid 104 and second stage solenoid 106 of the fuel regulator 78. Hence, the thermostat 118 can control the operation of the main 104 and second stage 106 solenoids for increasing and decreasing the manifold pressure of the fuel as discussed above. It should be appreciated that the higher and lower heating temperatures of the heating conduit 28 can be specific settings separated in a stepped manner or can be a continuous range of settings from which a higher and lower setting can be selected by the thermostat 118.

Turning also to FIGS. 12 and 13, the heating assembly 20 further includes the ignition control module 100 mounted in the second compartment 58 of the housing 54. For illustrative purposes the ignition control module 100 is schematically shown in FIG. 10. The ignition control module 100 is connected to the igniter 76 to control the operation thereof. The ignition control module 100 is also connected to a source of power (not shown) such as a 120 V AC power source. As shown in FIG. 13, an electrical circuit of the ignition control module 100 is illustrated. The ignition control module 100 is electrically connected to the igniter 76, the fuel regulator 78, as well as the thermostat 118. A plurality of indicator lights 120 may be connected to the ignition control module 100 and be mounted to the housing 54 for indicating the state of the heating assembly 20.

A differential pressure switch 122 is also mounted within the housing 54. In particular, the pressure switch 122 is mounted on the divider 60 to sense the air flow in the housing 54. Specifically, the pressure switch 122 is designed to monitor the levels of air flow and negative pressure within the housing 54. The pressure switch 122 is electrically connected to the ignition control module 100 to communicate with the ignition control module 100. Hence, when a desired level of air flow and negative pressure is within the housing 54, as sensed by the pressure switch 122, then the ignition control module 100 recognizes that it is safe to ignite the burner 68. The pressure switch 122 is calibrated to prevent unsafe buildup of carbon monoxide (CO), typically around 0.04%, in the heating assembly 20.

A sensor 124 is mounted adjacent the burner 68 for sensing a temperature of the air as the air exits the burner 68. The sensor 124 is also connected to the ignition control module 100 such that the ignition control module 100 can determine if the burner 68 is operating properly. Preferably, the sensor 124 is a flame rod 124 formed of a ceramic tube with a strip of metal extending into the flow path of the air and fuel mixture.

Referring back to FIGS. 4–7, a condensation pipe 126 may be alternatively mounted between the heating conduit 28 and the vacuum device 40 for receiving and subsequently discharging any condensation of gases within the heating conduit 28 in order to improve thermal efficiencies. The condensation pipe 126 would preferably be made of stainless steel to prevent corrosion of the condensation pipe 126. It should be appreciated that the heated gaseous mixture cools as it passes through the heating conduit 28. The condensation pipe 126 would typically be used in heating assemblies 20 that have a heating conduit 28 of a significant length. The lengthy heating conduits 28 have a greater likelihood that the gaseous mixture, as it is cooling within the heating conduit 28, will condense into a liquid. Heating conduits 28 are sometimes lengthened when the exhaust stack 44 is passing through a wall of a building 24 as opposed to a ceiling.

In operation, a user initially sets the thermostat 118 to a predetermined temperature, for example 75° F. Hence, the building 24 is to be heated to a temperature of 75° F. The thermostat 118 senses the current temperature in the building 24 and communicates with the ignition control module 100. If the temperature within the building 24 falls below the 75° F., then the beating assembly 20 is activated. Initially, the vacuum device 40 draws ambient air from the intake tube 62 and into the first compartment 56. The air is then expelled into the second compartment 58 through the pressure switch 122 in the divider 60. Pressurized air from the second compartment 58 flows into the inlet 70 of the burner 68 through the openings in the burner 68. Pressurized air from the second compartment 58 also flows around the outside of the burner 68 whereby the air is swirled by the vanes within the burner tube 74. Once an appropriate negative pressure has been reached, the ignition control module 100 communicates with the fuel regulator 78 to open the flow of fuel.

The ignition control module 100 must determine if a low fuel pressure is needed or if a high fuel pressure is needed. This determination will be based upon the difference between the desired temperature, 75° F., and the current temperature. If the current temperature is within a predetermined low range, such as within 5° F., (the temperature is 70° F.), then the low fuel pressure, or low temperature setting, will be selected. Alternatively, if the current temperature is outside of this low range, such as 15° F. (the temperature is 60° F.), then the high fuel pressure, or a high temperature setting, will be selected. It is, of course, within the scope of the invention to have either fixed or adjustable temperatures for low and high temperature settings.

In the above example, if the temperature within the building 24 is at 60° F., the thermostat 118 triggers, through the ignition control module 100, power to the second stage solenoid 106 to increase the manifold pressure of the fuel (high fuel pressure). In particular, the second stage solenoid 106 is energized and exerts force on the regulator valve 108, increasing the manifold pressure for a first stage of operation. The high fuel pressure provides more fuel for burning, resulting in more radiant heat.

When the temperature rises above 70° F., for example, the thermostat 118, through the ignition control module 100, cuts off power to the second stage solenoid 106 to decrease the manifold pressure of the fuel (low fuel pressure). In particular, the second stage solenoid 106 is de-energized and relaxes the regulator valve 108, decreasing the manifold pressure for a second stage of operation. The low fuel pressure provides less fuel for burning, resulting in less radiant heat.

The fuel from the fuel regulator 78 flows through the connecting line 88 and fuel orifice to mix with the air entering the openings of the burner 68. An air and fuel mixture then exits the outlet 72 of the burner 68. The ignition control module 100 triggers power to the igniter 76 to ignite the air/fuel mixture. The ignition results in combustion of the air/fuel mixture and hot exhaust gases are produced. As a safety measure, the sensor 124 continuously senses the temperature at the outlet 72 of the burner 68 to ensure that the air/fuel mixture is ignited.

The exhaust gases are pulled down the heating conduit 28 such that the heating conduit 28 is heated. In particular, the hot exhaust gases are swirled by the deflectors 34 to heat the heating conduit 28 which radiates infrared heat to the space being heated. The exhaust gases then cool due to the heat transfer and exit the heating conduit 28 through the exhaust stack 44.

Obviously, many modifications and variations of the present invention are possible in light of the above teachings and the invention may be practiced otherwise than as specifically described within the scope of the appended claims.

What is claimed is:

1. A heating assembly for variably heating ambient air, said heating assembly comprising;

an elongated heating conduit having an inlet and an exhaust;

a burner operatively connected to said inlet of said heating conduit for heating the ambient air to a plurality of predetermined temperatures as the air passes through said inlet;

a fuel regulator operatively connected to said burner for providing fuel to said burner at a low fuel pressure, which defines a low heating temperature, and a high fuel pressure, which defines a high heating temperature, such that the air can be heated to said plurality of predetermined temperatures; and a vacuum device connected to said exhaust of said heating conduit for pulling the air into said inlet and through said heating conduit to provide a negative pressure within said heating conduit during said heating of the air.

2. An assembly as set forth in claim 1 wherein said fuel regulator is further defined as a single fuel regulator for providing regulation of a single fuel.

3. An assembly as set forth in claim 1 further including a thermostat operatively connected to said fuel regulator for activating said fuel regulator to provide fuel to said burner at said low and high fuel pressures based upon a plurality of temperature settings.

4. An assembly as set forth in claim 3 wherein said thermostat is further defined as a two-stage thermostat having a low temperature setting for triggering said low fuel pressure and defining said low heating temperature, and a high temperature setting for triggering said high fuel pressure and defining said high heating temperature.

5. An assembly as set forth in claim 1 wherein said burner includes an inlet and an outlet with said inlet adapted to receive air and fuel and said outlet adapted to emit an air and fuel mixture for subsequent combustion.

6. An assembly as set forth in claim 5 further including an igniter mounted adjacent said burner for igniting the air and fuel mixture.

7. An assembly as set forth in claim 6 further including an ignition control module connected to said igniter to control operation thereof.

8. An assembly as set forth in claim 7 further including a sensor mounted adjacent said burner and connected to said ignition control module for sensing a temperature of the air as the air exits said burner.

9. An assembly as set forth in claim 5 wherein said burner has a circular venturi shaped configuration extending between said inlet and said outlet.

10. An assembly as set forth in claim 9 further including a screen mounted to both of said inlet and outlet of said burner with said screens defining a plurality of openings for allowing air and fuel to pass therethrough.

11. An assembly as set forth in claim 10 further including a plurality of vanes mounted circumferentially around said inlet and outlet of said burner for swirling air passing therethrough.

12. An assembly as set forth in claim 1 further including a housing connected to said inlet of said heating conduit with said burner mounted to said housing and at least partially disposed within said housing, said fuel regulator disposed within said housing, and said vacuum device disposed outside of and spaced from said housing.

13. An assembly as set forth in claim 12 wherein said housing defines an air tight compartment and said housing further includes an intake tube.

14. An assembly as set forth in claim 1 further including a reflector mounted to said heating conduit for reflecting heat generated from said heating conduit.

15. An assembly as set forth in claim 1 wherein said heating conduit defines a combustion chamber and further including a sinuous deflector mounted within said combustion chamber for causing the air and fuel to flow in a helical path through said heating conduit.

16. An assembly as set forth in claim 1 wherein said vacuum device includes a fan for pulling the air through the heating conduit and creating said negative pressure.

17. An assembly as set forth in claim 16 wherein said vacuum device further includes a controller for controlling an operation of said fan.

18. An assembly as set forth in claim 16 further including an exhaust stack connected to said fan for directing the flow of air away from said fan.

19. An assembly as set forth in claim 16 further including a vibration isolation boot mounted between said heating conduit and said fan for absorbing any vibrations caused by said fan.

20. An assembly as set forth in claim 1 further including a transition pipe mounted between said heating conduit and said vacuum device with a mechanical damper disposed within said transition pipe.

21. An assembly as set forth in claim 1 further including a condensation pipe mounted between said heating conduit and said vacuum device for receiving and subsequently discharging any condensation within said assembly.

22. A heating assembly for variably heating ambient air, said heating assembly comprising;

a plurality of elongated heating conduits each having an inlet, said heating conduits being interconnected to each other in such a manner as to define a common exhaust;

a burner operatively connected to each of said inlets of said heating conduits for heating the ambient air to a plurality of temperatures as the air passes through each of said inlets;

a fuel regulator operatively connected to each of said burners for providing fuel to said burners at a low fuel pressure, which defines a low heating temperature, and a high fuel pressure, which defines a high heating temperature, such that the air can be heated to said plurality of temperatures; and a vacuum device connected to said common exhaust of said heating conduits for pulling the air into each of said inlets and through each of said heating conduits to provide a negative pressure within each of said heating conduits during said heating of the air.

23. An assembly as set forth in claim 22 further including a thermostat operatively connected to each of said fuel regulators for activating said fuel regulators to provide fuel to said burners at said low and high fuel pressures based upon a plurality of temperature settings.

24. An assembly as set forth in claim 23 wherein each of said thermostats are further defined as a two-stage thermostat having a low temperature setting for triggering said low fuel pressure and defining said low heating temperature, and a high temperature setting for triggering said high fuel pressure and defining said high heating temperature.

25. An assembly as set forth in claim 22 further including an igniter mounted adjacent each of said burners for igniting the air and fuel mixture.

26. An assembly as set forth in claim 25 further including an ignition control module connected to each of said igniters to control operation thereof.

27. An assembly as set forth in claim 26 further including a sensor mounted adjacent to each of said burners and connected to each of said ignition control modules for sensing a temperature of the air as the air exits each of said burners.

28. An assembly as set forth in claim 22 further including a housing connected to said inlets of each of said heating conduits with a corresponding burner mounted to each of said housings and at least partially disposed within each of said housings, a corresponding fuel regulator disposed within each of said housings, and a single vacuum device disposed outside of and spaced from each of said housings.

29. An assembly as set forth in claim 22 wherein each of said heating conduits define a combustion chamber and further including a sinuous deflector mounted within each of said combustion chambers for causing the air and fuel to flow in a helical path through said heating conduits.

30. An assembly as set forth in claim 22 wherein said vacuum device includes a fan for pulling the air through each of the heating conduits and creating said negative pressure.

31. An assembly as set forth in claim 30 wherein said vacuum device further includes a controller for controlling an operation of said fan.

32. An assembly as set forth in claim 30 further including an exhaust stacked connected to said fan for directing the flow of air away from said fan.

33. An assembly as set forth in claim 30 further including a vibration isolation boot mounted between one of said heating conduits and said fan for absorbing any vibration from said vacuum device.

* * * * *